US007151496B2

(12) United States Patent
Casagrande et al.

(10) Patent No.: US 7,151,496 B2
(45) Date of Patent: Dec. 19, 2006

(54) PATCH ANTENNA INTEGRATED IN A WRISTWATCH

(75) Inventors: Arnaud Casagrande, Lignieres (CH); Yves Oesch, Neuchatel (CH)

(73) Assignee: Asulab S.A., Marin (CH)

( * ) Notice: Subject to any disclaimer, the term of this patent is extended or adjusted under 35 U.S.C. 154(b) by 284 days.

(21) Appl. No.: 10/922,829

(22) Filed: Aug. 23, 2004

(65) Prior Publication Data

US 2005/0054321 A1 Mar. 10, 2005

(30) Foreign Application Priority Data

Sep. 3, 2003 (EP) ..... 03019977

(51) Int. Cl.
*H01Q 1/12* (2006.01)
*H01Q 1/38* (2006.01)

(52) U.S. Cl. ..... 343/718; 343/700 MS

(58) Field of Classification Search ..... 343/700 MS, 343/702, 718, 846
See application file for complete search history.

(56) References Cited

U.S. PATENT DOCUMENTS 5,646,634 A 7/1997 Bokhari et al.
5,699,319 A * 12/1997 Skrivervik ..... 368/10
5,926,144 A * 7/1999 Bolanos et al. ..... 343/718
6,278,873 B1 8/2001 Itakura et al.
6,914,564 B1 * 7/2005 Barras et al. ..... 343/700 MS

FOREIGN PATENT DOCUMENTS

| | | |
|---|---|---|
| EP | 0 308 935 A1 | 3/1989 |
| FR | 2701616 | 8/1994 |
| JP | 2000-059241 | 2/2000 |

OTHER PUBLICATIONS

European Search Report, completed Feb. 9, 2004.
Ogawa, Koichi et al, "A Shoulder-Mounted Planar Antenna for Mobile Radio Applications", IEEE Transactions on Vehicular Technology, vol. 49, No. 3, May 2000., pp. 1041-1044.

* cited by examiner

*Primary Examiner*—Shih-Chao Chen
(74) *Attorney, Agent, or Firm*—Griffin & Szipl, P.C.

(57) ABSTRACT

There is disclosed a wristwatch (21) including a middle part (22) defining a middle plane (Y), conductive means (35, 36) for attaching the wristband (32) to the middle part, a radio-frequency module (27) arranged inside the middle part and connected, on the one hand, to a ground plane and, on the other hand, to a radiating element, insulated from each other and forming an antenna. The ground plane includes at least one conductive surface portion (37) of the wristband connected to the wristband attaching means and the middle part which is conductive, the latter being connected from the inside to the radio-frequency module. The radiating element includes a first conductive surface element (25) arranged in a substantially parallel plane to the middle plane defined by the middle part.

9 Claims, 3 Drawing Sheets

PATCH ANTENNA INTEGRATED IN A WRISTWATCH

This application claims priority from European Patent Application No. 03019977.2 filed Sep. 3, 2003, the entire disclosure of which is incorporated herein by reference.

FIELD OF THE INVENTION

The present invention concerns generally the integration of an antenna in a wristwatch, and more specifically, the arrangement in the wristwatch of the ground plane and the radiating element, these two elements forming an antenna.

The antenna can be used, in particular, for receiving and/or transmitting radio-electric signals, which are transmitted to a radio-frequency module integrated in the watch.

BACKGROUND OF THE INVENTION

A wristband antenna for a radio-electric receiver integrated in a watch is known from in the prior art, particularly from EP Patent No. 0 308 935. As is shown schematically in FIGS. 1A and 1B, watch 1 is formed of a case 2 containing radio-electric receiver 3 and a wristband 4. The back cover of the case includes a first metal part 5, which forms earth for receiver 3. The radiating element of the antenna is formed by a first metal conductor 6 arranged inside wristband 4 and connected to the input of radio-electric receiver 3. This first conductor 6 has the shape of a sinuous wire between the two side walls of wristband 4 whose unfolded length is close to $\lambda/4$, $\lambda$ being the wavelength corresponding to the central frequency of the signal to be received. The wristband antenna can also include a second conductor 7 arranged in the wristband and connected to the receiver's earth. This conductor 7 can have the form of a film. Each of the two conductors 6 and 7 is respectively arranged in one of the two strands 8 and 9 of wristband 4.

This wristband antenna behaves like a dipole antenna with an electric length equal to $\lambda 2$. When watch 1 is secured to the user's wrist, back cover 5 of the case, or the second strand 9 of the wristband, ensure that receiver 3 is earthed. The other strand 8 of the wristband forms a capacitor picking up the radial field around the arm. The dipole is formed, at least in part, by the sinuous structure of first conductor 6 allowing integration of the tuning inducting coil of the antenna in the strand itself. It is also possible to use a metal bezel 10, shown solely in FIG. 1B, insulated from back cover 5 of the case, to increase the effective mean height of the wristband antenna.

The electric connection between conductor elements 6 and 7 arranged in strands 8 and 9 of the wristband and receiver 3 arranged in case 2 can be achieved by means of electric contacts via bars, flexible connections by film or crimping, these elements not being shown in FIGS. 1A and 1B. The insulation between the receiver's earth and the radiating element forming the dipole antenna is assured by the body of case 2, which is consequently necessarily made with an insulating material.

Within the scope of the present invention, it has been demonstrated that such a dipole antenna integrated in wristband 4 of a watch has certain drawbacks. First of all, the electric connections between conductor elements 6 and 7 arranged in strands 8 and 9 of the wristband and receiver 3 have complications if one wishes to seal the interior of case 2. One solution, which would consist in forming these connections respectively via back cover 5 of the case and via bezel 10, both metallic, requires, however, either passing through insulating case 2, which makes manufacturing considerably more complex and expensive, or leaving electric conductors visible, which is undesirable, particularly from an aesthetic point of view. It will also be noted that such a dipole antenna integrated in the wristband requires the use, at least for the radiating element, of a conductor 6 of sinuous shape with a determined unfolded length dependant on the desired wavelength corresponding to the central frequency of the signal to be received, which may, depending upon the desired reception frequency, raise problems regarding the robustness of the antenna structure and thus operating reliability over time.

SUMMARY OF THE INVENTION

It is thus a general object of the present invention to provide a solution which assures a sealed connection between the antenna elements external and internal to the middle part of the watch in a simple, inexpensive and reliable manner, without thereby prejudicing the aesthetic appearance of the assembly, while ensuring that this wristwatch assembly, and the antenna integrated therein, is robust.

The present invention therefore concerns a wristwatch of the aforementioned type whose features are listed in claim 1.

Advantageous embodiments of the present invention form the subject of the dependent claims.

Again for the purposes stated hereinbefore, it is also advantageous to ensure that the radiating element is integrated in the watch itself. Thus, an antenna solution of the patch antenna type is particularly suited to these constraints, such an antenna including a ground plane, a dielectric substrate and one or several radiating elements of reduced size with respect to that of the ground plane. A "ground plane" means here one or several surface or volume conductors connected to each other and acting as ground for the radio-frequency module.

It is thus proposed to make the radiating element by means of a metal back cover insulated from the middle part via a dielectric element. This dielectric element can be formed by a plastic gasket with temperature constant permittivity.

Advantageously, the radiating element includes two surface conductors each arranged in a substantially parallel plane to the middle plane defined by the middle part and connected to each other so as to define a radiating cylinder. The two surface conductors can be made by means respectively of the metal back cover of the watch and a metal layer applied over a part of the non-visible face of the dial so as to be insulated from the middle part, the uncovered part of the dial being formed by a dielectric material.

Advantageously, the wristband includes first and second strands, in each of which a flexible conductive plate is overmoulded and connected to the middle part via the conductive attachment means.

BRIEF DESCRIPTION OF THE DRAWINGS

Other features and advantages of the present invention will appear more clearly upon reading the following detailed description of embodiments of the invention given solely by way of non-limiting example and illustrated by the annexed drawings, in which.

DESCRIPTION OF PREFERRED EMBODIMENTS

Figure 1A:
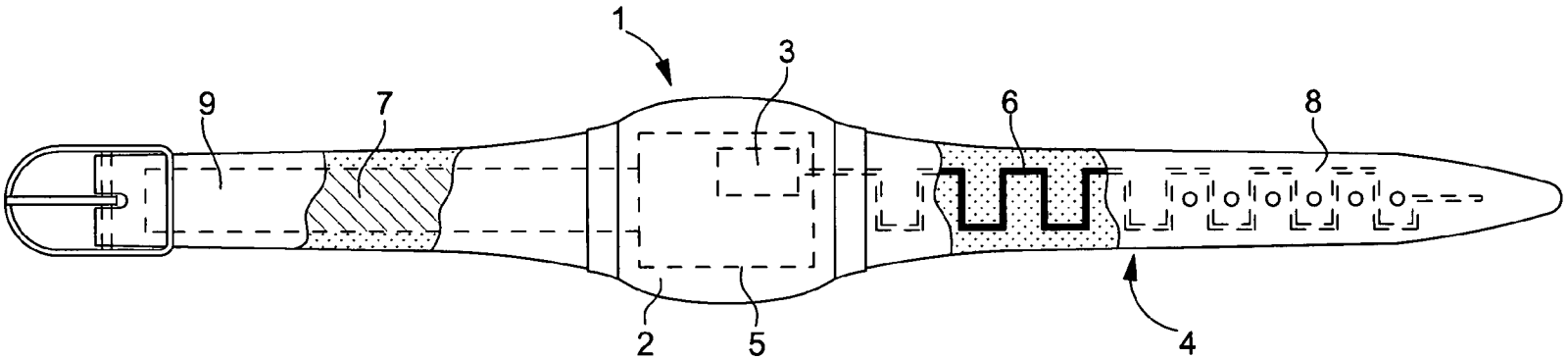
Fig. 1A ( Prior art )
FIGS. 1A and 1B, already described, show a top view and a cross-section of a wristband antenna for a radio-electric receiver integrated in a watch according to the prior art.
Figure 1B:
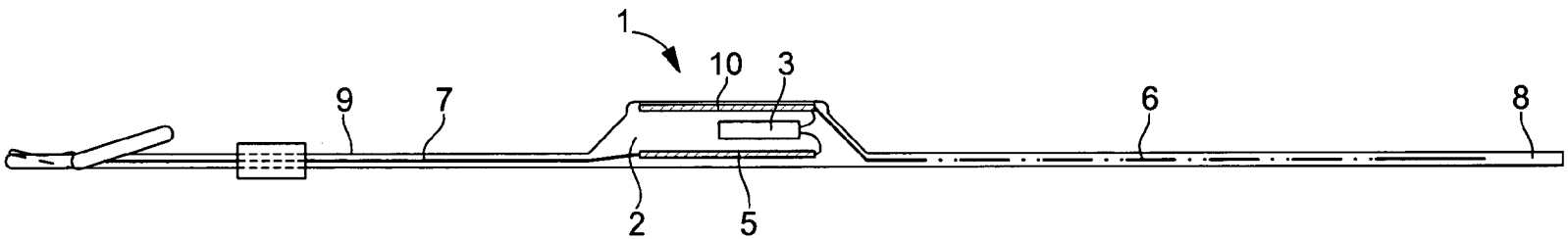
Fig. 1B ( Prior art )

In the following description, most of the elements that do not have any direct relationship with the scope of the present invention, like for example, the watch movement, the motors, the power sources, the time display means, etc., have not been shown in the various Figures for the sake of simplification. Identical elements common to the various Figures bear the same reference numerals.

It is one of the objects of the invention to integrate an antenna in a wristwatch containing a radio-frequency module for receiving and/or transmitting radio-electric signals. For this purpose, preferably, an antenna including the broadest ground plane possible is used.

Figure 2:
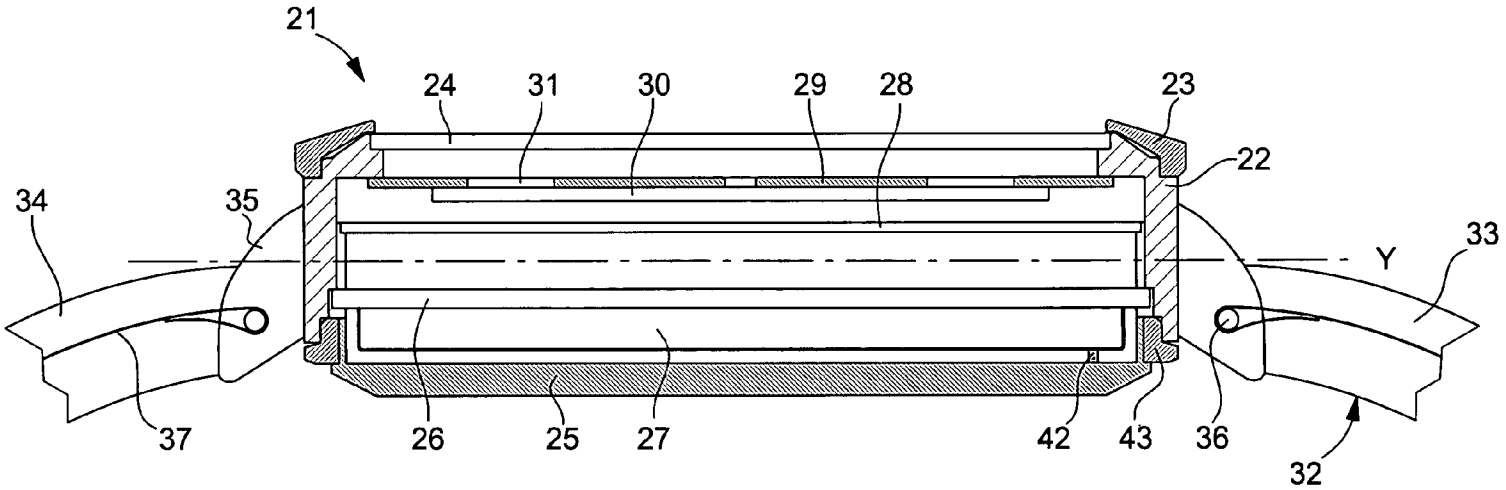
FIG. 2 shows a schematic cross-section of a wristwatch according to a first embodiment of the invention.

First of all, by way of non-limiting example, reference will be made to FIG. 2 showing a schematic cross-section of a wristwatch according to a first embodiment of the invention.

Figure 4:
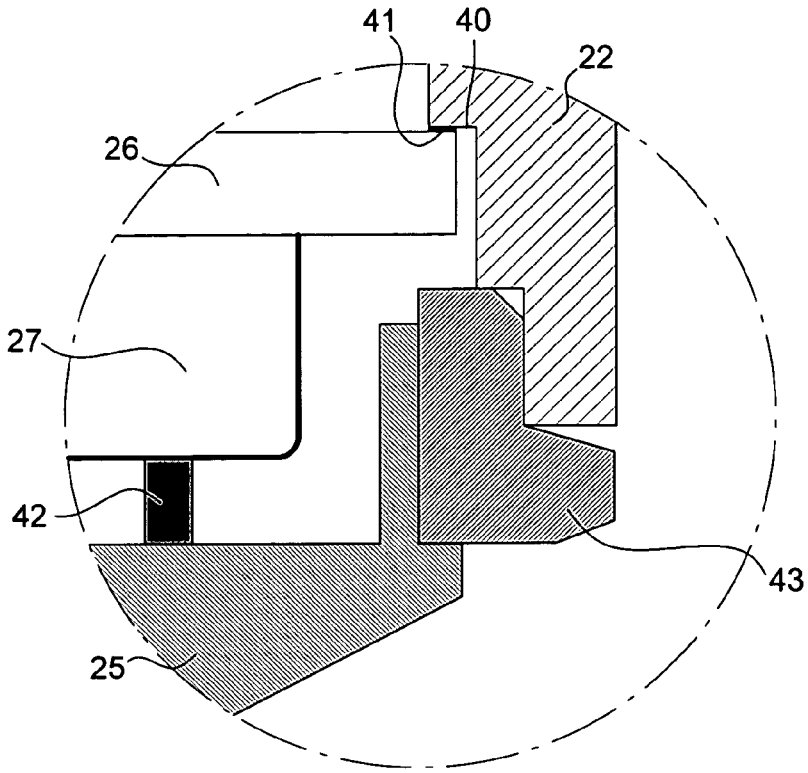
FIG. 4 shows an enlarged view of the connections between the radio-frequency module and the antenna elements, as well as the insulation of said elements from each other, according to the first and second embodiments of the invention.

Watch 21, as shown, includes a metal middle part 22, able to made in a single piece with or separately from a bezel 23, middle part 22 defining a middle plane Y of the watch. Watch 21 is closed at the top by means of a glass 24 supported by middle part 22 and fixed in a sealed manner, for example, by being driven into a material, for example, made of Hytrel, forming a gasket. Within the scope of this first embodiment, the watch is closed at the bottom by means of a metal back cover 25, insulated from middle part 22 via a gasket 43, preferably made of a malleable plastic, for example Hytrel. An enlarged view of the zone in dotted lines is given in FIG. 4.

Inside the watch are shown the printed circuit 26, supporting the radio-frequency module 27, the printed circuit clock 28 to which the watch movement (not shown) is fixed, and dial 29 that can have apertures 31 through which display means 30 are visible, like, for example, a liquid crystal display device. Other display means, not shown here, can also be provided, in particular, hands driven by the watch movement can be placed between glass 24 and dial 29.

Reception and/or transmission of electric signals by radio-frequency module 27 is carried out by means of an antenna, advantageously of the patch type, including, on the one hand, a ground plane, as broad as possible, and on the other hand, one or several radiating elements, the ground plane and/or the radiating elements being insulated by means of a dielectric element having a substantially temperature constant permittivity.

Thus, the watch includes a wristband 32 formed by first and second strands 33 and 34, shown here in a truncated fashion, each of the strands being attached to middle part 22 via conductive attachment means. The attachment means are formed, for each wristband strand, by two metal horns 35 secured to middle part 22 between which is arranged a bar 36, also made of metal. Inside, at least one wristband strand 32 there is arranged a flexible conductive plate 37, the end of which, on the middle part side, forms an electric contact with the attachment means, for example, by bending this end of plate 37 around metal bar 36.

Thus, the ground plane of the antenna includes a conductive plate 37, the conductive attachment means 35 and 36 and metal middle part 22. Advantageously, it will be noted that the two strands 33 and 34 of the wristband are each provided with a conductive plate 37 for the purpose of increasing to a maximum the surface area of the antenna's ground plane. The electric contact between the ground plane and radio-frequency module 27 is achieved via an annular conductive path printed on the periphery of printed circuit 26 making contact with an annular shoulder of the middle part provided for such purpose and the detail of which is given in FIG. 4.

The radiating element of the antenna includes at least one conductive surface element arranged in a substantially parallel plane to the middle plane (Y) defined by middle part 22 and, according to this first embodiment of the invention, this surface element is formed by metal back cover 25, the latter being electrically connected to radio-frequency module 27 by any suitable means, for example, by means of a screw or any other electric contact element 42.

Figure 3:
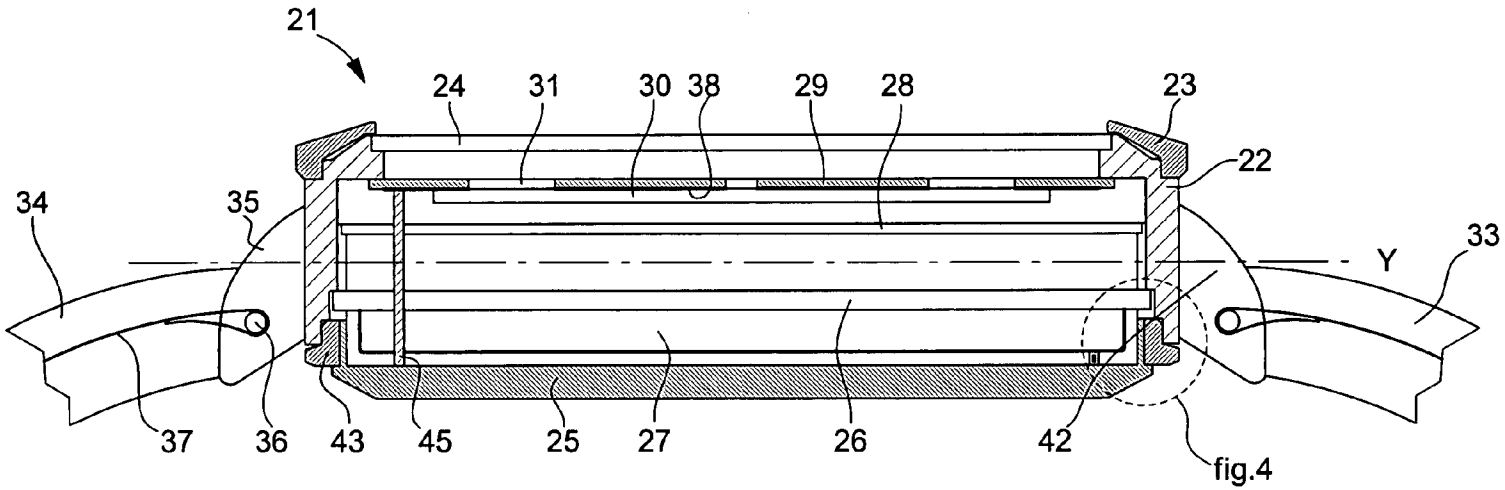
FIG. 3 shows a schematic cross-section of a wristwatch according to a second embodiment of the invention.

Secondly, also by way of example, reference will be made to FIG. 3, showing a schematic cross-section of a wristwatch according to a second embodiment of the invention.

This second embodiment differs from the first embodiment presented hereinbefore, essentially as regards the structure used for making the radiating element of the antenna. Indeed, it has been demonstrated within the scope of the present invention that the radiating element has better features, particularly reception features, with a cylindrical radiating structure. Thus, in order to obtain said radiating cylinder, the radiating element includes two conductive surface elements, each being arranged in a substantially parallel plane to the middle plane defined by middle part 22.

According to this second embodiment, the two surface elements are formed, on the one hand, by metal back cover 25 and, on the other hand, by a metal layer 38 applied over a part of the non visible face of dial 29, so as not to be in contact with middle part 22, the uncovered part of the dial being formed by a dielectric material insulating the middle part from this metal layer 38. An example deposition of this metal layer 38 on dial 29 is given in FIG. 5.

The electric contact between the two surface elements forming the radiating cylinder can be achieved by any suitable electric contact element 45, like for example a screw, insulated from the ground plane.

FIG. 4 shows, again by way of example, an enlarged view of the dotted line zones of FIGS. 2 and 3, showing the connections between radio-frequency module 27 and the antenna elements, and the insulation of these elements from each other, according to the first and second embodiments of the invention described hereinbefore.

As already mentioned, metal middle part 22 is an element of the ground plane and metal back cover 25 corresponds to the radiating element or to only a part thereof. The electric connections of these antenna elements with radio-frequency module 27 are achieved in the following manner. Middle part 22 has a shoulder 40 against which printed circuit 26 supporting radio-frequency module 27 abuts. In order to assure the electric connection, a conductive path 41 is deposited on the abutting zone, i.e. on the periphery of printed circuit 26. As regards back cover 25, the electric contact could be achieved by means of a suitable contact element 42.

Insulation between the middle part and the back cover is achieved by means of a deformable, sealed dielectric element 43. Thus, this element 43 not only allows the ground plane to be insulated from the radiating element, but also seals the inside of the watch. Preferably, this dielectric element 43 is a gasket made of malleable plastic with a substantially temperature constant permittivity.

Figure 5:
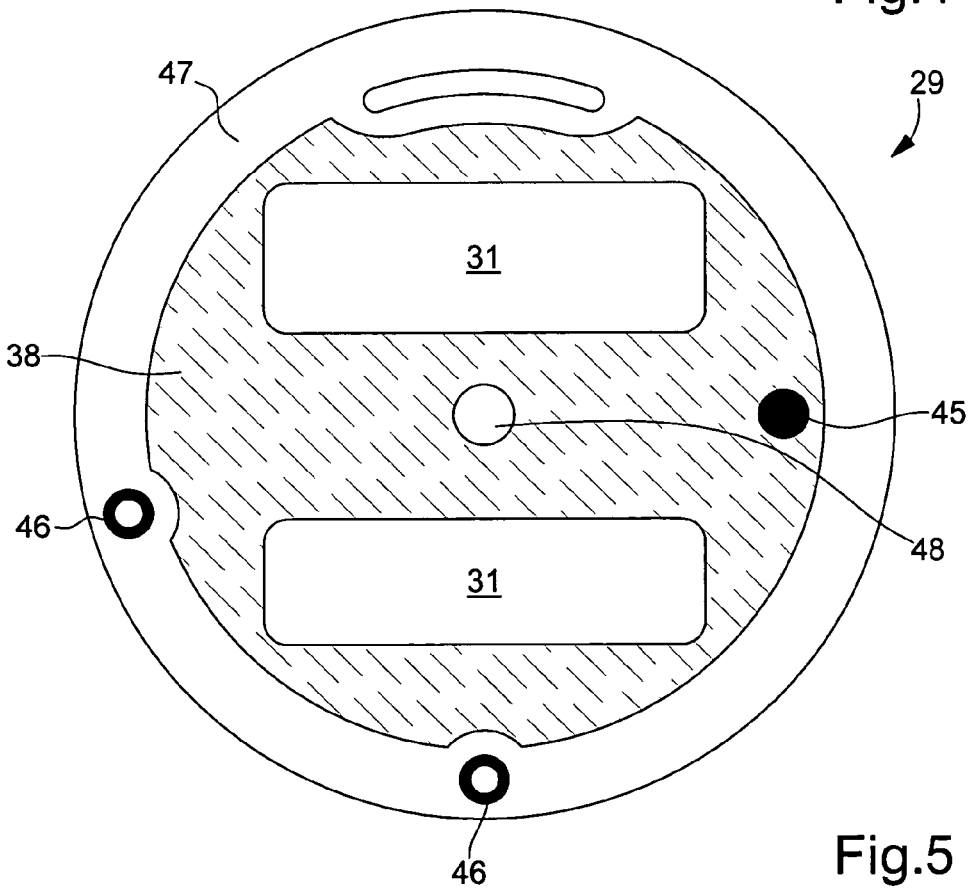
FIG. 5 shows a bottom view of the watch dial according to the second embodiment of the invention.

FIG. 5 shows a bottom view of dial 29 of watch 21 according to the second embodiment of the invention. Apertures 31 are seen again, allowing display elements (not shown here) to be seen through dial 29, and an aperture 48 used to allow an arbor supporting analogue display means arranged between the dial and glass. In order to hold the dial in the watch, fixing means 46 are conventionally provided, for example screws, to which electric contact element 45 is advantageously added. This element 45 is arranged on metal layer 38 in order to form the electric contact between this layer and the radio-frequency module. Metal layer 38 can take any form, but it preferably covers the largest available surface. Finally, insulation between the middle part and the metal layer is achieved by a peripheral zone 47 that is not covered by metal layer 38, this zone 47 being preferably made of a dielectric material with a substantially temperature constant permittivity.

It will be understood that various modifications and/or improvements obvious to those skilled in the art can be made to the various embodiments of the invention described in the present description without departing from the scope of the invention defined by the annexed claims.

In particular, as regards the conductive attachment means used for establishing an electrical contact between the conductive parts of the wristband to the metal middle part, according to an alternative embodiment, in each of the strands, a flexible conductive plate 37 is used, the end of which, on the middle part side, forms metal bar 36, the two elements 36 and 37 forming only one piece.

It will be noted that it is also possible to provide only a single wristband strand with a conductive plate.

What is claimed is:

1. A wristwatch including a middle part defining a middle plane, conductive means for attaching a wristband to the middle part, a radio-frequency module arranged inside the middle part and connected, on the one hand, to a ground plane and, on the other hand, to a radiating element, insulated from each other and forming an antenna, the ground plane including at least one conductive surface portion of the wristband connected to the wristband attaching means, wherein the ground plane further includes the middle part which is conductive, the latter being connected from the inside to the radio-frequency module and wherein the radiating element includes a first conductive surface element arranged in a substantially parallel plane to the middle plane defined by the middle part.

2. The wristwatch according to claim 1, wherein the first conductive surface element is made by means of a metal back cover insulated from the middle part via a dielectric element.

3. The wristwatch according to claim 2, wherein the dielectric element is formed by a malleable plastic gasket having a substantially temperature constant permittivity.

4. The wristwatch according to claim 2, wherein the radiating element includes a second conductive surface element also arranged in a substantially parallel plane to the middle plane defined by the middle part and connected to the first surface element so as to define a radiating cylinder.

5. The wristwatch according to claim 4, including a dial having a first face visible through a glass and a second, not visible, face, opposite the first face, wherein the second conductive surface element is made by means of a metal layer applied onto a part of the dial face that is not visible so as not to establish contact with the middle part, and wherein the uncovered part of the dial is formed by a dielectric material insulating the middle part from the second surface element.

6. The wristwatch according to claim 1, the wristband including first and second strands, wherein conductive surface portion is formed by a flexible conductive plate overmoulded in one of the two wristband strands and connected to the middle part via the attaching means.

7. The wristwatch according to claim 6, wherein the ground plane further includes a second flexible conductive plate overmoulded in the other wristband strand and also connected to the middle part via the attaching means.

8. The wristwatch according to claim 7, wherein the attaching means include, for each wristband strand, two metal horns secured to the middle part between which is arranged a metal bar and wherein the conductive plate or plates are bent around the corresponding bar or bars.

9. The wristwatch according to claim 7, wherein the attaching means include, for each wristband strand, two metal horns secured to the middle part and wherein the conductive plate or plates have a rigid bar-shaped end cooperating with the horns.

* * * * *